US005562380A

United States Patent [19]

Hempfling et al.

[11] Patent Number: 5,562,380

[45] Date of Patent: Oct. 8, 1996

[54] PROTECTIVE SEAM PLATE

[75] Inventors: Dave C. Hempfling, Chicago; Parimal M. Vadhar, Buffalo Grove; Ronald J. Huffmon, Northlake, all of Ill.

[73] Assignee: Illinois Tool Works Inc., Glenview, Ill.

[21] Appl. No.: 314,465

[22] Filed: Sep. 28, 1994

[51] Int. Cl.[6] ..... F16B 43/02

[52] U.S. Cl. ..... 411/542; 411/533; 52/410

[58] Field of Search ..... 52/410, 409, 512, 52/746.11; 411/531, 915, 377, 155, 542, 371, 903; 27/447

[56] References Cited

U.S. PATENT DOCUMENTS

| | | | |
|---|---|---|---|
| 1,631,819 | 6/1927 | Ivory | 411/155 X |
| 3,168,321 | 2/1965 | Glicksman | 411/915 X |
| 3,671,371 | 6/1972 | Wolf | 52/410 X |
| 3,855,383 | 12/1974 | Dahlgren | 29/447 X |
| 4,026,183 | 5/1977 | Bart | 411/915 X |
| 4,712,959 | 12/1987 | Hasau | 411/533 |
| 5,018,329 | 5/1991 | Hasan et al. | 52/410 |

*Primary Examiner*—Carl D. Friedman

*Assistant Examiner*—David Jersen

*Attorney, Agent, or Firm*—Schwartz & Weinrieb

[57] ABSTRACT

A protective seam plate retains a flexible membrane of a roofing system in place without tearing the flexible membrane during high winds. The protective seam plate comprises a seam plate having a web with a periphery and top and bottom surfaces. A protective ring surrounds the seam plate web periphery and overlies the web top and bottom surfaces around and adjacent the web periphery. The protective ring has a smooth continuous surface that is contacted by the flexible membrane when the flexible membrane lifts off the roof during high winds. The protective seam plate may be manufactured by heat shrinking a tube of heat shrinkable material surrounding the periphery of the seam plate web. Alternately, the protective ring may be an L-shaped ring that is assembled to the seam plate by bending a leg over the web top surface. The protective seam plate may also be fabricated by bending a flange that is integral with the seam plate web such that the flange partially overlies the web top surface. In that design, the web bottom surface and the flange bottom surface cooperate to form the smooth continuous surface presented to the flexible membrane.

37 Claims, 3 Drawing Sheets

PROTECTIVE SEAM PLATE

BACKGROUND OF THE INVENTION

1. Field of the Invention

This invention pertains to holddown devices, and more particularly to apparatus for retaining flexible membranes to flat surfaces, a method of manufacturing the holddown apparatus or device, a roofing system incorporating the holddown device, and a method of constructing the roofing system.

2. Description of the Prior Art

It is well known to cover the exterior surface of a roof with sheets or membranes of flexible waterproof material. To retain the membranes in place on the roof, various types of disc-like stress or seam plates have been developed. For example, FIG. 1 shows a simplified view of a prior stamped metal seam plate 1 in use to retain a membrane 3 upon a typical roof deck 5. A layer of insulation 13 is normally placed between the deck 5 and the membrane 3. The seam plate 1 has a circular periphery 7 and a bottom surface 9. When the seam plate is stamped, a burr is often formed along the circular edge 15 between the periphery 7 and the bottom surface 9. The seam plate is clamped to the roof deck with the seam plate bottom surface 9 placed against the membrane 3. The seam plate is mechanically attached to the roof deck by a screw 11 that passes through a central hole of the seam plate and engages the roof deck.

When a wind storm occurs, the wind acts to pull the roof from overhead. This phenomena is known as negative uplift pressure or pullover pressure, because the resulting force is away from the building roof. The higher the wind speed, the greater the pullover pressure. As a result, substantial uplift pressure is often produced on the membrane 3, and the membrane is pulled toward the sky. In high winds, the upward force on the membrane creates a large force on the seam plate 1 as well as on the screw 11. In some instances, the seam plate may even bend slightly.

FIG. 2 shows in simplified fashion a membrane 3 that is under strong uplift pressure. The membrane becomes creased along the edge 15 between the periphery 7 and the bottom surface 9 of the seam plate 1. During excessively high winds, the burr around the seam plate edge 15 tends to tear the membrane, thus possibly initiating membrane failure.

Other examples of prior seam plates for roofing membranes may be seen in U.S. Pat. Nos. 4,890,968; 4,945,699; and 5,018,329. The seam plate of U.S. Pat. No. 4,945,699 includes prongs that grip the membrane. Careful attention must be paid to the design and manufacture of that seam plate to assure that the prongs do not puncture through the membrane.

Another prior seam plate is made from molded plastic and has a dozen or more rather long needle-like prongs. That seam plate is undesirably expensive, and the prongs have a tendency to weaken the membrane.

Thus, a need exists for improvements in the seam plates that retain a flexible membrane to a roof.

SUMMARY OF THE INVENTION

In accordance with the present invention, a protective seam plate is provided that greatly improves the reliability of membrane equipped roofing systems. This is accomplished by apparatus that includes a seam plate having a protective ring around the seam plate periphery.

The seam plate is a generally flat piece of material defining a longitudinal axis and having a central opening. A web having top and bottom surfaces extends radially from the central opening and terminates in a circular periphery. The junction of the web bottom surface and periphery is normally a sharp edge. To increase the rigidity of the seam plate, the web may be corrugated. The preferred material for the seam plate is galvanized steel. An insert of a synthetic plastic material is secured within the seam plate central opening.

The protective ring has a generally U-shaped cross section with a center leg that encircles the periphery of the seam plate web and side legs that partially overlie the top and bottom surfaces of the seam plate web. The external surface of the protective ring is smooth, continuous, and free of sharp corners.

A preferred protective ring is made from a short band of shrink tubing. The inner diameter of the shrink band is slightly greater than the diameter of the seam plate web. The seam plate is placed inside of the shrink band such that the seam plate longitudinal axis is generally coincident with the tube longitudinal axis. The shrink band is heated in a manner that causes it to bend around the seam plate web periphery into the U-shaped cross section having a smooth continuous external surface and overlying the seam plate web around and adjacent the periphery thereof.

When the protective seam plate is installed on a roof, the membrane never contacts the sharp edge at the seam plate web periphery. Instead, the membrane is in contact with the protective ring leg that overlies the seam plate web bottom surface. During high winds, the smooth continuous external surface of the protective ring presents a gradual transitional curve to the membrane as the membrane lifts off the roof. As a result, the tendency of the membrane to tear when subjected to high pullover pressure is practically eliminated. Additional advantages of the invention include the ability to clamp the protective seam plate and membrane more tightly to the roof deck due to the thickness of the protective ring side leg under the seam plate web bottom surface, and also increased corrosion resistance of the seam plate web periphery.

In an alternate construction of the protective seam plate, the protective ring is manufactured as a ring having a generally L-shaped cross section. A first leg of the ring surrounds the periphery of the seam plate web. The second leg of the protective ring abuts the bottom surface of the seam plate web. The first and second legs cooperate to form a smooth continuous external surface. The free end of the first leg is bent, as by heating, over-the top surface of the seam plate web. The protective ring first leg need not be bent over the seam plate web all the way around the periphery; at least three discrete bent-over locations are sufficient to keep the protective ring in place on the seam plate. If desired, the outer periphery of the protective ring can have a shoulder that facilitates installation of the protective seam plate by machine. In that situation, the shoulder has outer and bottom surfaces that cooperate to form the smooth continuous external surface that the membrane contacts during high pullover pressures.

In a further modified embodiment of the invention, the protective ring is integral with the seam plate. In that construction, the seam plate is stamped with a flange that extends around and is coplanar with the seam plate web. The flange is bent backwardly upon itself so as to overlie a portion of the web top surface. The result is that the bottom surfaces of the web and flange cooperate to form a smooth continuous external surface.

The method and apparatus of the invention, using a protective ring around a seam plate periphery, thus presents a smooth continuous surface to membranes retained on a roof by the seam plate. The probability of the membrane tearing at the seam plate periphery is remote, even in high winds.

BRIEF DESCRIPTION OF THE DRAWINGS

Other advantages, benefits, and features of the present invention will become apparent to those skilled in the art upon reading the following detailed description of the invention in connection with the accompanying drawings in which like reference characters designate like or corresponding parts throughout the several views, and wherein:

BRIEF DESCRIPTION OF THE DRAWINGS

Figure 1:
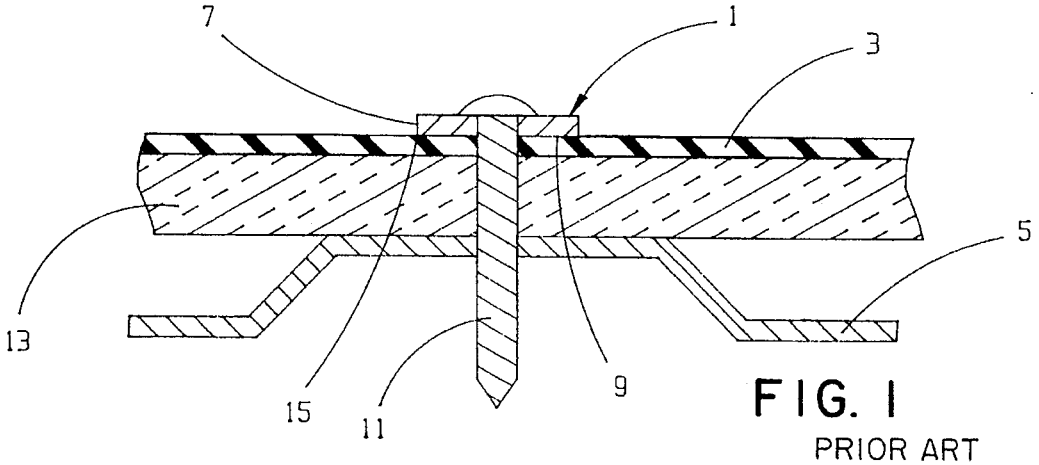
FIG. 1 PRIOR ART

FIG. 1 is a simplified cross sectional view of a prior seam plate in use to retain a flexible membrane on a roof.

Figure 2:
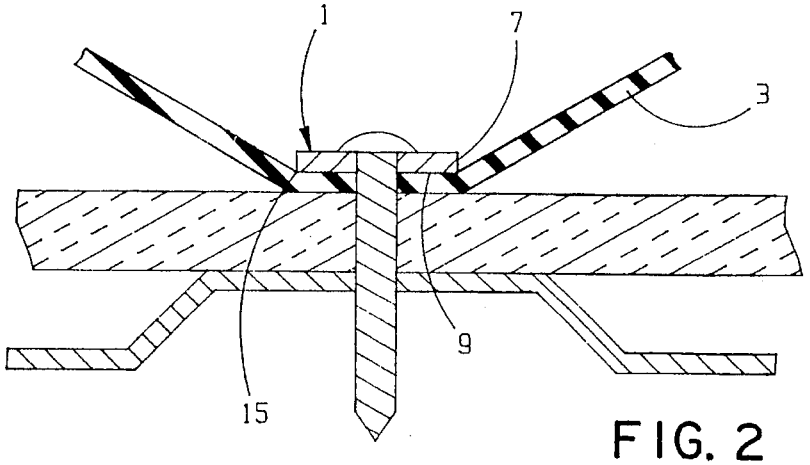
FIG. 2 PRIOR ART

FIG. 2 is a view similar to FIG. 1, but showing the membrane in a typical position during high winds.

Figure 3:
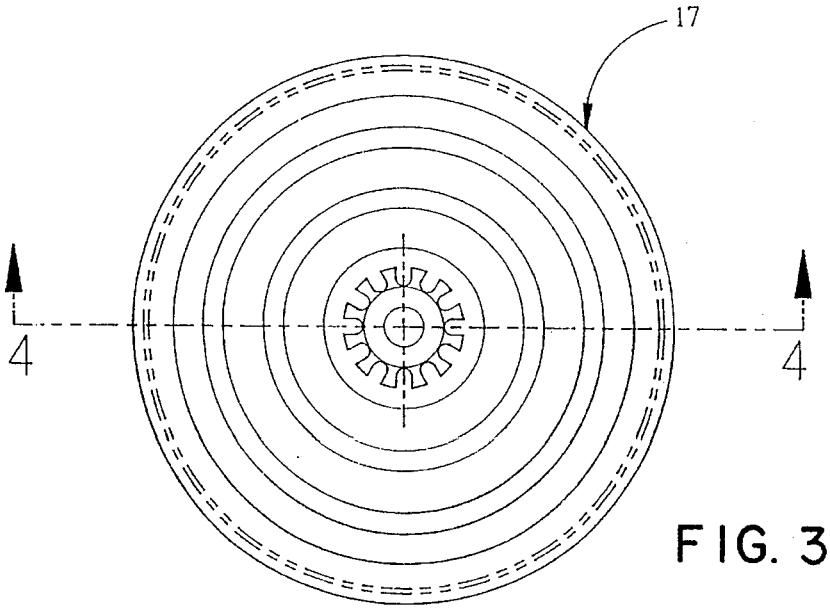

FIG. 3 is a top view of a protective seam plate of the present invention.

Figure 4:
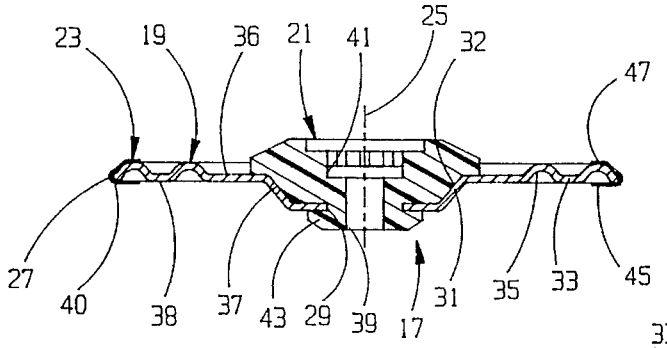

FIG. 4 is a cross sectional view taken along line 4—4 of FIG. 3.

Figure 5:
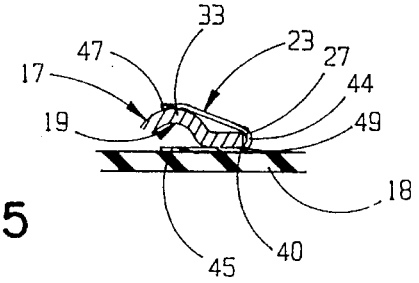

FIG. 5 is an enlarged view of a portion of the protective seam plate in place on a membrane.

Figure 6:
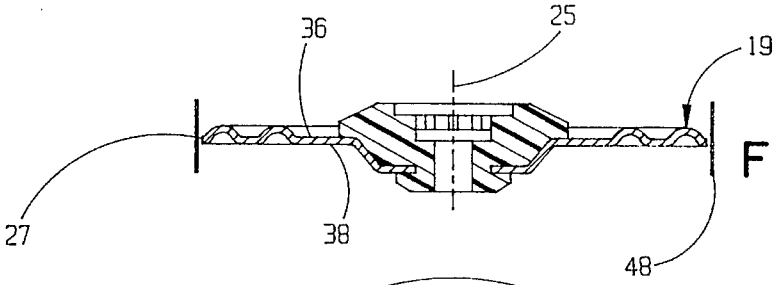

FIG. 6 is a cross sectional view of a first embodiment of a protective seam plate during a stage in the manufacture thereof.

Figure 7:
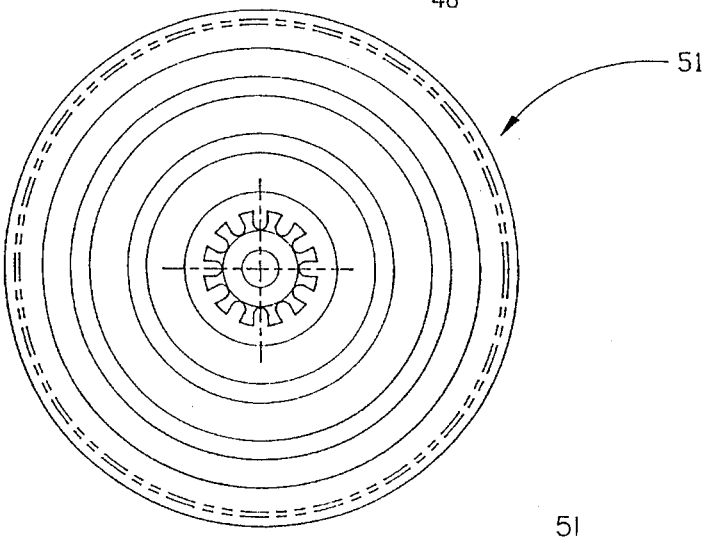

FIG. 7 is a view similar to FIG. 3, but showing an alternate construction for the protective seam plate of the invention.

Figure 8:
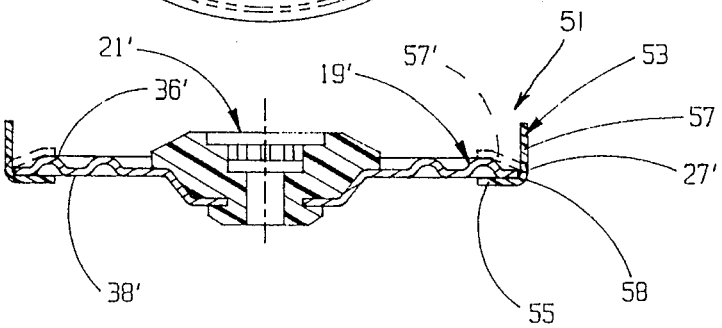

FIG. 8 is a cross sectional view of the protective seam plate of FIG. 7 during a stage in the manufacture thereof.

Figure 9:
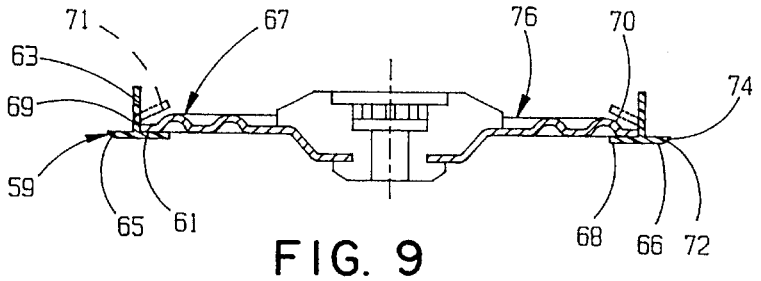

FIG. 9 is a view similar to FIG. 8, but showing a protective ring having a shoulder thereon.

Figure 10:
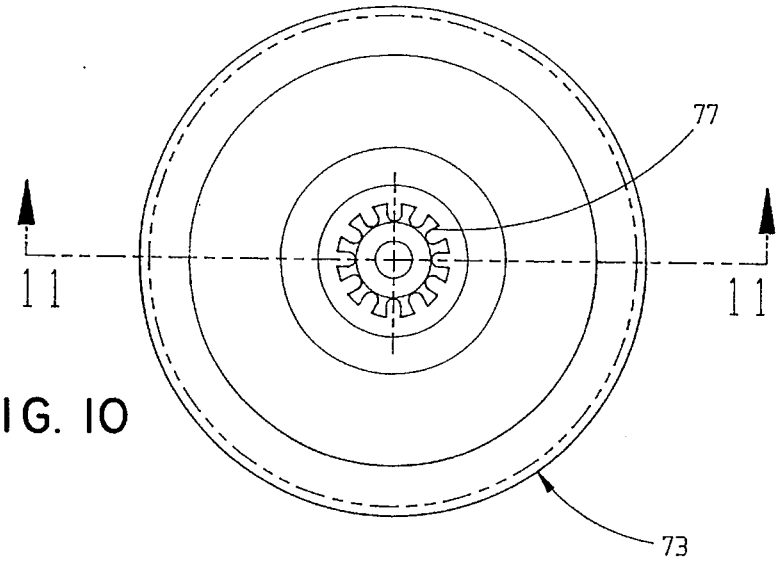

FIG. 10 is a top view of a modified embodiment of the invention.

Figure 11:
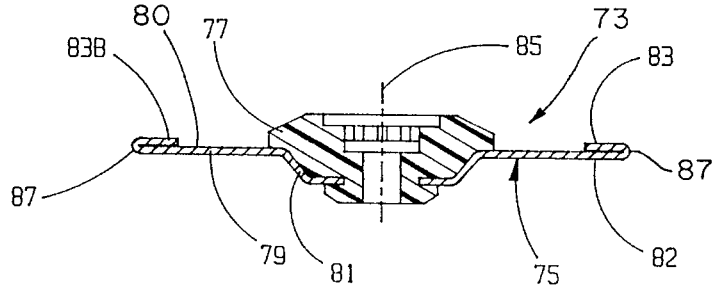

FIG. 11 is a cross sectional view taken along line 11—11 of FIG. 10.

Figure 12:
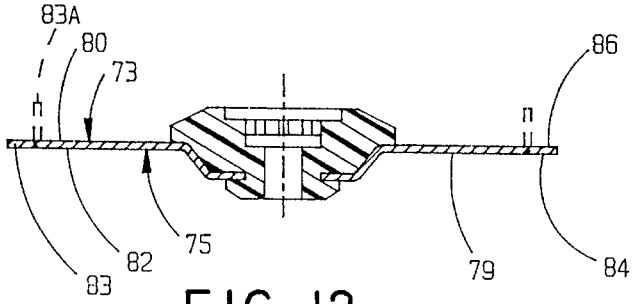

FIG. 12 is a view similar to FIG. 11, but showing the protective seam plate of FIGS. 10 and 11 during a stage in the manufacture thereof.

DETAILED DESCRIPTION OF THE ILLUSTRATED EMBODIMENTS

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 3–5, a protective seam plate 17 is illustrated that embodies the present invention. The protective seam plate 17 is particularly useful for retaining a flexible membrane 18 to roofing decks, but it will be understood that the invention is not limited to building construction applications.

The protective seam plate 17 is comprised of a seam plate 19, an insert 21, and a protective ring 23. The seam plate 19 is preferably manufactured as a stamping of galvanized steel. The seam plate defines a longitudinal axis 25 and a central opening 29 concentric with the longitudinal axis. The seam plate is dished in a region 31 proximate the central opening 29. The dished region 31 preferably includes a frusto-conical surface 32. A web 33 lies in a plane generally perpendicular to the longitudinal axis 25 and extends from the dished region 31 to a circular periphery 27. For increased rigidity of the web 33, it may be fabricated with one or more concentric corrugations 35. The web has a top surface 36 and a bottom surface 38. The web bottom surface 38 and periphery 27 meet along a sharp circular edge 40.

The insert 21 is preferably made of a synthetic plastic material such as polypropylene. It is molded with a frusto-conical surface 37 that corresponds to the frusto-conical surface 32 of the seam plate dished region 31. The insert is further fabricated with a through hole 39 and a counterbore 41. An integral collar 43 secures the insert in the seam plate central opening 29. The insert through hole 39 and counterbore 41 receive a conventional screw, not shown, that is used to clamp the protective seam plate 17 to a roof deck, as is known in the art.

In accordance with the present invention, the protective ring 23 protects the membrane 18 from the sharp edge 40 of the seam plate 19. For that purpose, the protective ring has a generally U-shaped cross section with a center leg 44 that surrounds the periphery 27 of the seam plate web 33. A first side leg 45 of the protective ring overlies a portion of the web bottom surface 38 around and adjacent the periphery. A second side leg 47 overlies a similar portion of the web top surface 36.

The protective ring 23 is preferably manufactured from a heat shrink plastic material, such as a polyvinylchloride plastic shrink tubing or other heat shrinkable plastic material. Looking also at FIG. 6, the protective ring is assembled to the seam plate 19 by starting with a short tube or band 48 of the plastic shrink material. The inner diameter of the shrink band 48 is slightly larger than the diameter of the seam plate web periphery 27. The seam plate is inserted into the shrink band with the seam plate longitudinal axis 25 generally coincident with the longitudinal axis of the shrink band. Then heat is applied to the shrink band, causing it to shrink and conform around the seam plate web periphery and partially overlie the web top and bottom surfaces 36 and 38, respectively.

When the protective seam plate 17 is installed on a roofing system, the membrane 18 is protected against tearing due to contact with the seam plate sharp edge 40. Instead, the protective ring 23 presents a smooth continuous external surface 49 to the membrane when the membrane lifts off the roof during high winds. Thus, the surface 49 enables the membrane to bend gradually and greatly reduces the risk of the membrane tearing.

A corollary benefit of the protective seam plate 17 is that it can be clamped more tightly to the roof deck than was possible with prior seam plates. That is because the protective ring leg 45 interposed between the membrane 18 and the seam plate edge 40 prevents the seam plate from acting as a cookie cutter and cutting the membrane around the seam plate web periphery 27. Further, the protective ring 23 provides improved corrosion resistance to the seam plate. Since the seam plate periphery is not coated and is therefore more susceptible to corrosion than the rest of the seam plate, the protective ring protects the periphery from harmful elements.

FIGS. 7 and 8 show an alternate protective seam plate 51 that comprises a seam plate 19' and insert 21' that are substantially similar to the seam plate 19 and insert 21 described previously in conjunction with FIGS. 3–6. The protective seam plate 51 also includes a protective ring 53 that can be molded from any thermoplastic or polymeric material such as polypropylene. The protective ring 53 is initially in the form of an annular ring having an L-shaped cross section with a first leg 55 and a second leg 57. The first and second legs 55 and 57, respectively, cooperate to form a smooth continuous external surface 58. The bottom surface 38' of the seam plate 19' is placed against the protective ring first leg 55 such that the protective ring second leg 57 surrounds the seam plate periphery 27'. Then the protective ring second leg is heated and bent over the seam plate top surface 36', as is shown by phantom lines 57'. It is not necessary that the protective ring second leg be bent over the seam plate around the entire periphery 27'. Rather, the protective ring second leg can be heated and bent at a number of discrete locations; I prefer that there be at least four such bent-over locations. In either case, the result is a protective seam plate 51 having a smooth continuous surface 58 that functions in the same exemplary manner as the surface 49 of the protective seam plate 17.

In FIG. 9, a protective ring 59 is depicted that has a generally T-shaped cross section, with a bottom leg 61, a side leg 63, and a radially extending shoulder 65. The shoulder 65 is an extension of the bottom leg 61, such that the bottom surface 66 of the shoulder 65 is coplanar with the bottom surface 68 of the bottom leg 61. The corner 72 between the shoulder bottom surface 66 and the shoulder outer surface 74 is smooth and gradual. The protective ring 59 may be molded from the same thermoplastic or polymeric material as the protective ring 53 described above in conjunction with FIGS. 7 and 8.

The protective ring 59 is assembled to a seam plate 67 by bending the side leg 63 over the seam plate periphery 69 so as to overlie a portion of the seam plate top surface 70, as shown in phantom lines 71. The side leg 63 can be bent over completely or at several discrete locations around the seam plate periphery 69. The shoulder 65 is very useful for enabling the resulting protective seam plate 76 to be dispensed and clamped to a roof deck using a dispensing and fastener-driving machine such as that illustrated in U.S. Pat. No. 4,890,968. A further advantage of the seam plate 59 is that during use the shoulder 65 can bend as the underlying membrane (not illustrated in FIG. 9) is pulled upwardly in high winds. The bottom surface 66 of the bent shoulder presents a transitional smooth continuous surface of large radius to the uplifted membrane.

Further in accordance with the present invention, the protective ring need not be a separate piece from the seam plate. Rather, as depicted in FIGS. 10–12, a protective seam plate 73 can be manufactured in which the protective ring is integral with the seam plate. In that design, a seam plate 75 is stamped from galvanized sheet steel with a web 79 and a dished region 81. The web 79 and dished region 81 of the seam plate 75 may be the same as the web 33 and dished region 31 of the seam plate 19 described above. Alternately, as shown, the web 79 of the seam plate 75 may be flat, that is, the web has flat top and bottom surfaces 80 and 82, respectively. In either case, the dished region 81 receives an insert 77 that is the same as the insert 21 also described previously.

The seam plate 75 is provided with a flange 83 around the outermost portion of the web 79. The flange 83 has a bottom surface 84 and a top surface 86. The flange extends sufficiently far from the longitudinal axis 85 of the seam plate 75 to enable the flange to be bent, as shown by phantom lines 83A and solid lines 83B, over the seam plate web. Consequently, a smooth continuous surface 87 is created between the web and flange surfaces 82 and 83, respectively. The smooth continuous surface 87 of the protective seam plate 73 functions in the same manner as the surface 49 of the protective seam plate 17 (FIG. 5).

In summary, the results and advantages of roofing systems using flexible membranes can now be more fully realized. The protective seam plate of the present invention enables roofing membranes to resist both higher pullover pressure and higher clamping forces than prior seam plates allowed. This desirable result comes from using the protective ring around the periphery of the metallic seam plate. The protective ring presents a smooth continuous surface to the membrane when the membrane lifts off the roof during high winds. The protective ring further acts to retard corrosion of the seam plate periphery.

It will also be recognized that in addition to the superior performance of the protective seam plate of the invention, its construction is such as to add but minimal cost to its manufacture. In fact, even with the protective ring incorporated into the metal seam plate, the total cost is still less than the total cost of prior single-piece plastic seam plates. Also, since the components are made of a rugged and simple design, their need for maintenance is virtually non-existent.

Thus, it is apparent that there has been provided, in accordance with the invention, a protective seam plate that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A protective seam plate for holding down a roofing material member, secured to a roofing substrate, under high wind conditions, comprising:

a seam plate having a central region for seating a head portion of a headed fastener; a through-aperture for receiving a shank portion of said headed fastener to be inserted into said roofing substrate; and a web portion, extending radially outwardly from and annularly surrounding said central fastener head seating region, having top and bottom surfaces, and a periphery, remote from said central fastener head seating region, that cooperates with said web bottom surface so as to form a relatively sharp edge portion; and ring means disposed about said periphery of said web portion and remote from said central fastener head seating region for covering portions of said web top surface and said relatively sharp edge portion of said seam plate, as defined between said periphery and said web bottom surface, and thereby present a smooth continuous surface to said roofing material member retained beneath said bottom surface of said web portion of said seam plate whereby said roofing material member is protected by said ring means against tearing by said relatively sharp edge portion of said seam plate when said roofing material member is forced into contact with said ring means under said high wind conditions.

2. The protective seam plate of claim 1 wherein the ring means overlies the web bottom surface adjacent the web periphery completely around the web periphery.

3. The protective seam plate of claim 2 wherein the ring means overlies the web top surface adjacent the web periphery completely around the web periphery.

4. The protective seam plate of claim 2 wherein the ring means overlies the web top surface adjacent the web periphery at a plurality of discrete locations around the web periphery.

5. The protective seam plate of claim 1 wherein the ring means comprises a tube of heat shrinkable material surrounding the periphery of the seam plate web and overlying the web top and bottom surfaces around and adjacent the web periphery.

6. The protective seam plate of claim 1 wherein the ring means comprises a protective ring having a first leg that surrounds the periphery of the seam plate web and a second leg that overlies the bottom surface of the seam plate web around and adjacent the web periphery, the protective ring first leg being bent to overlie the top surface of the seam plate web around and adjacent the web periphery, the protective ring first and second legs having respective external surfaces that cooperate to form the ring means smooth continuous surface.

7. The protective seam plate of claim 1, wherein said ring means comprises:

a first leg underlying said web bottom surface and disposed around and adjacent to said periphery of said web portion;

a second leg connected to said first leg, surrounding said periphery of said web portion, and being bent radially inwardly so as to overlie said web top surface around and adjacent to said periphery of said web portion; and shoulder means connected to said first and second legs so as to extend circumferentially around said ring means for facilitating handling of said protective seam plate by dispensing apparatus, and defining said smooth continuous surface presented to said roofing material member.

8. The seam plate as set forth in claim 1, wherein:

said central fastener head seating region has a dished, axially recessed configuration; and an insert, for seating said head portion of said headed fastener, is fixedly secured to said dished head seating region of said seam plate.

9. The seam plate as set forth in claim 8, wherein:

said insert is fabricated from a plastic material.

10. The seam plate as set forth in claim 9, wherein:

said plastic material comprises polypropylene.

11. The seam plate as set forth in claim 1, wherein:

said web portion of said seam plate is provided with annular corrugations for increasing the rigidity of said web portion.

12. The seam plate as set forth in claim 5, wherein:

said heat shrinkable material comprises polyvinylchloride.

13. The seam plate as set forth in claim 6, wherein:

said ring means is fabricated from polypropylene.

14. A protective seam plate for holding down a roofing material member, secured to a roofing substrate, under high wind conditions, comprising:

a seam plate having a central region for seating a head portion of a headed fastener; a through-aperture for receiving a shank portion of said headed fastener to be inserted into to said roofing substrate; and a web portion, extending radially outwardly from and annularly surrounding said central fastener head seating region, having top and bottom surfaces, and a periphery, remote from said central fastener head seating region; and flange means fixedly connected to and circumferentially surrounding said periphery of said web portion so as to be remote from said central fastener head seating region, having top and bottom surfaces that are coplanar with said top and bottom surfaces, respectively, of said web portion, and being bent radially inwardly so as to overlie an annular portion of said top surface of said web portion disposed adjacent to said periphery of said web portion such that said bottom surfaces of said web portion and said flange means cooperate to form a smooth continuous external surface for said roofing material member retained beneath said bottom surface of said web portion of said seam plate when said seam plate is secured to said roofing substrate by said headed fastener whereby said roofing material member is protected by said flange means against tearing by said seam plate when said roofing material member is forced into contact with said flange means under said high wind conditions.

15. The seam plate as set forth in claim 14, wherein:

said central fastener head seating region has a dished, axially recessed configuration; and an insert, for seating said head portion of said head fastener, is fixedly secured to said dished head seating region of said seam plate.

16. The seam plate as set forth in claim 15, wherein:

said insert is fabricated from a plastic material.

17. The seam plate as set forth in claim 16, wherein:

said plastic material comprises polypropylene.

18. A roofing system, comprising:

a rigid roof deck;

a flexible membrane covering said roof deck;

at least one rigid protective seam plate, disposed upon said flexible membrane, having a central region for seating a head portion of a headed fastener; a central opening for receiving a shank portion of said headed fastener to be inserted into said roof deck; and a web portion, extending radially outwardly from sand annularly surrounding said central fastener head seating region, having top and bottom surfaces, and a periphery, remote from said central fastener head seating region, that cooperates with said web bottom surface so as to form a relatively sharp edge portion;

protective ring means disposed about said periphery of said web portion and remote from said central fastener head seating region for covering portions of said web top surface and said relatively sharp edge portion of said seam plate, as defined between said periphery and said web bottom surface, and thereby present a smooth continuous external surface to said flexible membrane retained beneath said bottom surface of said web portion of said seam plate when said seam plate is secured to said roof deck by said headed fastener whereby said flexible membrane is protected by said ring means against tearing by said relatively sharp edge portion of said seam plate when said flexible membrane lifts off said roof deck and is forced into contact with said ring means during high wind conditions; and headed fastener means, having a head portion thereof seated upon said central fastener head seating region of said seam plate and said shank portion thereof inserted through said central opening of said seam plate and into said roof deck, for securing said seam plate to said roof deck with said flexible membrane interposed between said web portion of said seam plate and said roof deck.

19. The roofing system of claim 18 wherein the protective ring means comprises:

a. a first side leg covering the seam plate web top surface around and adjacent the seam plate web periphery;

b. a center leg surrounding the periphery of the seam plate web; and c. a second side leg covering the seam plate web bottom surface around and adjacent the seam plate web periphery, the protective ring means second leg being interposed between the seam plate web and the flexible membrane when the protective seam plate is secured to the roof deck, the second side leg and the center leg cooperating to form the protective ring means smooth continuous external surface, so that the flexible membrane can bend gradually and without tearing around the protective ring means smooth continuous external surface when the flexible membrane lifts off the roof deck.

20. The roofing system of claim 19 wherein the protective ring means is fabricated from a tube of heat shrinkable material surrounding the periphery of the seam plate web and heated to bend the tube into a generally U-shaped cross section having a center leg that surrounds the seam plate web periphery and first and second legs that overlie the top and bottom surfaces, respectively, of the web around and adjacent the web periphery.

21. The roofing system of claim 18 wherein the protective ring means is formed as a ring having a generally L-shaped cross section with a first leg that surrounds the seam plate web periphery and a second leg that underlies the web bottom surface around and adjacent the web periphery, the first leg being bent over the web top surface around and adjacent the web periphery, the protective ring means first and second legs cooperating to form the smooth continuous external surface.

22. The roofing system of claim 21 wherein the protective ring means first leg is bent over the seam plate web completely around the web periphery.

23. The roofing system of claim 21 wherein the protective ring means first leg is bent over the seam plate web at a plurality of discrete locations around and adjacent the web periphery.

24. The roofing system of claim 18, wherein said protective ring means comprises:

a first leg underlying said web bottom surface and disposed around and adjacent to said periphery of said web portion;

a second leg connected to said first leg, surrounding said periphery of said web portion, and being bent radially inwardly so as to overlie said web top surface around and adjacent to said periphery of said web portion; and shoulder means connected to said first and second legs and extending radially outwardly from said first leg for cooperating with apparatus that dispenses and secures said protective seam plate to said roof deck, and for defining said smooth continuous surface presented to said flexible membrane.

25. A roofing system, comprising:

a rigid roof deck;

a flexible membrane covering said rigid roof deck;

at least one rigid protective seam plate, disposed upon said flexible membrane, having a central region for seating a head portion of a headed fastener; a central opening for receiving a shank portion of said headed fastener to be inserted into said roof deck; and a web portion, extending radially outwardly from and annularly surrounding said central fastener head seating region, having top and bottom surfaces, and a periphery, remote from said central fastener head seating region;

flange means fixedly connected to and circumferentially surrounding said periphery of said web portion so as to be remote from said central fastener head seating region, having top and bottom surfaces that are coplanar with said top and bottom surfaces, respectively, of said web portion, and being bent radially inwardly so as to overlie an annular portion of said top surface of said web portion disposed adjacent to said periphery of said web portion such that said bottom surfaces of said web portion and said flange means cooperate to form a smooth continuous external surface around said seam plate for said flexible membrane retained beneath said bottom surface of said web portion of said seam plate when said seam plate is secured to said roof deck by said headed fastener whereby said flexible membrane is protected by said flange means against tearing by said seam plate when said flexible membrane lifts off said roof deck and is forced into contact with said flange means during high wind conditions; and headed fastener means, having a head portion thereof seated upon said central fastener head seating region of said seam plate and said shank portion thereof inserted through said central opening of said seam plate and into said roof deck, for securing said seam plate to said roof deck with said flexible membrane interposed between said web portion of said seam plate and said roof deck.

26. A method of manufacturing a protective seam plate for holding down a roofing material member, secured to a roofing substrate, under high wind conditions, comprising the steps of:

providing a seam plate having a central region for seating a head portion of a headed fastener; a through-aperture for receiving a shank portion of said headed fastener to be inserted into said roofing substrate; and a web portion, extending radially outwardly from and annularly surrounding said central fastener head seating region, having top and bottom surfaces, and a periphery, remote from said central fastener head seating region, that cooperates with said web bottom surface so as to form a relatively sharp edge portion;

surrounding said periphery of said web portion, remote from said central fastener head seating region, with a protective ring; and bending said protective ring so as to overlie said top and bottom surfaces of said web portion, and to cover said periphery of said web portion and said relatively sharp edge portion of said seam plate so as to simultaneously form a smooth continuous external surface upon said protective ring for encountering said roofing material member retained beneath said bottom surface of said web portion of said seam plate when said seam plate is secured to said roofing substrate by said headed fastener whereby said roofing material member is protected by said protective ring against tearing by said relatively sharp edge portion of said seam plate when said roofing material member is forced into contact with said protective ring under said high wind conditions.

27. The method of claim 26 wherein:

the step of surrounding the web periphery with a protective ring comprises the step of surrounding the web periphery with a tube of heat shrinkable plastic material; and the step of bending the protective ring comprises the step of heating the tube of heat shrinkable material to overlie the top and bottom surfaces of said web portion around and adjacent the web periphery.

28. A method of manufacturing a protective seam plate for holding down a roofing material member, secured to a roofing substrate, under high wind conditions, comprising the steps of:

providing a seam plate having a central region for seating a head portion of a headed fastener; a through-aperture for receiving a shank portion of said headed fastener to be inserted into said roofing substrate; and a web portion, extending radially outwardly from and annularly surrounding said central fastener head seating region, having top and bottom surfaces, and a periphery, remote from said central fastener head seating region, that cooperates with said web bottom surface so as to form a relatively sharp edge portion;

providing a protective ring having a smooth continuous external surface; and assembling said protective ring upon said seam plate so as to surround said periphery of said web portion, remote from said central fastener head seating region, such that said protective ring overlies said to and bottom surfaces of said web portion, and covers said periphery of said web portion and said relatively sharp edge portion of said seam plate, and thereby presents said smooth continuous external surface of said protective ring to said roofing material member retained beneath said bottom surface of said web portion of said seam plate when said seam plate is secured to said roofing substrate said headed fastener whereby said roofing material member is protected by said protective ring against tearing by said relatively sharp edge portion of said seam plate when said roofing material member is forced into contact with said protective ring under said high wind conditions.

29. The method of claim 28, wherein:

the step of providing a protective ring comprises the step of providing a generally L-shaped ring comprising a first leg and a second leg; and the step of assembling the protective ring upon said seam plate comprises the steps of surrounding said web periphery with said first leg of said protective ring; underlying said bottom surface of said web portion, around and adjacent to the periphery thereof, with said second leg of said protective ring the junction of said first and second legs of said protective ring cooperating to form said smooth continuous external surface of said protective ring; and bending said first leg of said protective ring so as to overlie said top surface of said web portion around and adjacent to said periphery of said web portion.

30. The method of claim 29 wherein the step of bending the protective ring first leg comprises the step of bending the protective ring first leg to overlie the seam plate web completely around and adjacent the seam plate web periphery.

31. The method of claim 29 wherein the step of bending the protective ring first leg comprises the step of bending the protective ring first leg at a plurality of discrete locations around and adjacent the seam plate web periphery.

32. The method of claim 28, wherein:

the step of providing a protective ring comprises the step of providing a ring having a first leg, a second leg, and a shoulder portion that extends radially outwardly from said second leg, said shoulder portion defining said smooth continuous external surface of said protective ring; and the step of assembling said protective ring upon said seam plate comprises the steps of surrounding said periphery of said web portion with said first leg of said protective ring; underlying said bottom surface of said web portion, around and adjacent to the periphery thereof, with said second leg of said protective ring; and bending said first leg of said protective ring so as to overlie said top surface of said web portion around and adjacent to said periphery of said web portion.

33. A method of manufacturing a protective seam plate for holding down a roofing material member, secured to a roofing substrate, under high wind conditions, comprising the steps of:

providing a seam plate having a central region for seating a head portion of a headed fastener; a through-aperture for receiving a shank portion of said headed fastener to be inserted into said roofing substrate; a web portion, extending radially outwardly from and annularly surrounding said central fastener head seating region, having top and bottom surfaces, and a periphery, remote from said central fastener head seating region; and a flange fixedly connected to and circumferentially surrounding said periphery of said web portion so as to be remote from said central fastener head seating region, and having top and bottom surfaces that are coplanar with said top and bottom surfaces, respectively, of said web portion; and bending said flange radially inwardly so as to overlie an annular portion of said top surface of said web portion disposed adjacent to said periphery of said web portion such that said bottom surfaces of said web portion and said flange cooperate to form a smooth continuous external surface around said seam plate for said roofing material member retained beneath said bottom surface of said web portion of said seam plate when said seam plate is secured to said roofing substrate by said headed fastener whereby said roofing material member is protected by said flange against tearing by said seam plate when said roofing material member lifts off said roofing substrate and is forced into contact with said flange during said high wind conditions.

34. A method of constructing a roofing system, comprising the steps of:

providing a roofing deck;

laying a flexible membrane upon said roofing deck;

providing at least one protective seam plate with a central region for seating a head portion of a headed fastener; providing said seam plate with a central opening for receiving a shank portion of said headed fastener to be inserted into said roofing deck so as to secure said at least one protective seam plate to said roofing deck; providing said seam plate with a web portion, extending radially outwardly from and annularly surrounding said central fastener head seating region, having top and bottom surfaces and a periphery remote from said central fastener head seating region; and forming rounded edges upon said top and bottom surfaces of said web portion so as to define a smooth continuous external peripheral surface to be encountered by said flexible membrane under high wind conditions; and clamping said at least one protective seam plate to said roofing deck, by inserting said shank portion of said headed fastener into said roofing deck, such that said flexible membrane is interposed between said web portion of said at least one protective seam plate and said roofing deck, and said continuous smooth external peripheral surface of said web portion of said at least one protective seam plate is presented to said flexible membrane whereby said flexible membrane is protected against tearing by said rounded peripheral edges of said web portion of said at least one protective seam plate when said flexible membrane lifts off said roofing deck and is forced into contact with said smooth continuous external peripheral surface of said web portion of said at least one protective seam plate, as defined by said rounded peripheral edges formed upon said top and bottom surfaces of said web portion of said at least one protective seam plate, during high wind conditions.

35. The method of claim 34, wherein:

the step of providing at least one protective seam plate comprises the steps of providing a protective ring having a first leg and a second leg; and assembling said protective ring to seam plate with said first leg of said protective ring surrounding said web periphery, and said second leg underlying said bottom surface of said web portion around and adjacent to said periphery thereof, said first and second legs of said protective ring cooperating to form said smooth continuous external surface of said protective seam plate; and the step of clamping said protective seam plate to said roofing deck comprises the step of placing said second leg next to said flexible membrane and thereby presenting said smooth continuous external surface of said protective seam plate to said flexible membrane.

36. The method of claim 34, wherein:

the step of providing at least one protective seam plate comprises the steps of providing a protective ring having a first leg, a second leg, and a shoulder defining said smooth continuous external surface; and assembling said protective ring to said seam plate with said first leg of said protective ring surrounding said web periphery and said second leg of said protective ring underlying said bottom surface of web portion around and adjacent to said periphery thereof; and the step of clamping said at least one protective seam plate to said roof deck comprises the step of placing said second leg and said shoulder next to said flexible membrane thereby presenting said smooth continuous external surface of said at least one protective seam plate to said flexible membrane.

37. The method of claim 34, wherein:

the step of providing said at least one protective seam plate comprises the steps of surrounding said web periphery with a tube of heat shrinkable material; and heating said tube of heat shrinkable material so as to cause it to bend over and overlie said top and bottom surfaces of said web portion around and adjacent to said web periphery and thereby simultaneously form said smooth continuous external surface upon said periphery of said web portion.

* * * * *